US009536415B2

(12) United States Patent
De Luca et al.

(10) Patent No.: US 9,536,415 B2
(45) Date of Patent: Jan. 3, 2017

(54) NON-CONTACT NOISE ATTENUATION WATER FLOW SYSTEM AND METHOD FOR DETECTING WASHING COMPLIANCE

(71) Applicants: Nicholas P. De Luca, Washington, DC (US); Koichi Sato, Saratoga, CA (US); Harry Rivera, Moorpark, CA (US)

(72) Inventors: Nicholas P. De Luca, Washington, DC (US); Koichi Sato, Saratoga, CA (US); Harry Rivera, Moorpark, CA (US)

(73) Assignee: Sealed Air Corporation (US), Duncan, SC (US)

( * ) Notice: Subject to any disclaimer, the term of this patent is extended or adjusted under 35 U.S.C. 154(b) by 0 days.

(21) Appl. No.: 14/348,372

(22) PCT Filed: Sep. 28, 2012

(86) PCT No.: PCT/US2012/057756
§ 371 (c)(1),
(2) Date: Mar. 28, 2014

(87) PCT Pub. No.: WO2013/049462
PCT Pub. Date: Apr. 4, 2013

(65) Prior Publication Data

US 2014/0320291 A1 Oct. 30, 2014

Related U.S. Application Data

(60) Provisional application No. 61/541,772, filed on Sep. 30, 2011.

(51) Int. Cl.

| | |
|---|---|
| ***G08B 23/00*** | (2006.01) |
| ***G08B 21/20*** | (2006.01) |
| ***G08B 21/24*** | (2006.01) |

(52) U.S. Cl.
CPC ..... *G08B 21/20* (2013.01); *G08B 21/245* (2013.01)

(58) Field of Classification Search
CPC ..... G08B 21/245; G08B 23/00
USPC ..... 340/573.1, 573.4, 562, 567, 588, 572.1, 340/572.4, 572.7; 702/121, 123, 127
See application file for complete search history.

(56) References Cited

U.S. PATENT DOCUMENTS

| | | | | |
|---|---|---|---|---|
| 6,975,231 | B2 * | 12/2005 | Lane | G08B 21/245 340/539.1 |
| 8,237,558 | B2 * | 8/2012 | Seyed Momen | G01S 1/70 222/23 |
| 2002/0019709 | A1 | 2/2002 | Segal | |
| 2007/0064986 | A1 | 3/2007 | Johnson | |
| 2007/0257803 | A1 | 11/2007 | Munro et al. | |

(Continued)

FOREIGN PATENT DOCUMENTS

| | | | |
|---|---|---|---|
| WO | 2007090470 | A1 | 8/2007 |
| WO | 2010026581 | A2 | 3/2010 |
| WO | 2011062658 | A1 | 5/2011 |

*Primary Examiner* — Tai T Nguyen
(74) *Attorney, Agent, or Firm* — Rupert B. Hurley, Jr.

(57) ABSTRACT

A low cost solution for detecting the flow of water in a sink using a non-contact vibration sensor coupled with a computer vision system and a passive switched RFID tag that becomes active upon detection of water flow. In some embodiments, the water flow forms an active antennae system for the RFID tag. The sensor comprises a piezo electric film attached at the underside of a water receptacle, for example, a sink so as to collect the sound generated by water splashing or hitting the sink and a vision system using active detection techniques.

13 Claims, 13 Drawing Sheets

(56) References Cited

U.S. PATENT DOCUMENTS

2010/0328076 A1* 12/2010 Kyle ..... G06F 19/327
340/573.1
2011/0234598 A1 9/2011 Scarola et al.

* cited by examiner

FIG. 12a

1200

HAND WASHING REPORT 1202

1214

| EMPLOYEE 1204 | DURATION OF HANDWASHING (SECONDS) 1206 | | | ELAPSED TIME BETWEEN HANDWASHING (HRS:MINS) | | NUMBER OF HANDWASHING EVENTS 1220 | VIOLATION TYPE 1222 |
|---|---|---|---|---|---|---|---|
| | MIN 1208 | AVG 1210 | MAX 1212 | AVG 1214 | MAX 1218 | | |
| | 15.0 | 42.00 | 69.0 | 2:01 | 8:48 | 10 | |
| | 71.0 | 78.00 | 85.0 | 6:57 | 6:57 | 2 | ... |
| | 34.0 | 37.50 | 41.0 | 3:57 | 3:57 | 2 | ... |
| | 50.0 | 68.67 | 102.0 | 1:14 | 1:25 | 6 | ... |
| | 15.0 | 39.00 | 63.0 | 2:29 | 2:29 | 1 | ... |
| | 41.0 | 41.00 | 41.0 | ... | ... | 1 | ... |
| | 35.0 | 35.00 | 35.0 | ... | ... | 1 | ... |
| | 29.0 | 38.33 | 49.0 | 2:57 | 4:11 | 3 | ... |
| | 40.0 | 40.00 | 40.0 | ... | ... | 1 | ... |

VIOLATION TYPE

1. MORE THAN 10 MINUTES ELAPSED WITHOUT HAND WASHING
2. LEFT THE ROOM WITHOUT WASHING THEIR HANDS

} 1224

... NONE

NON-CONTACT NOISE ATTENUATION WATER FLOW SYSTEM AND METHOD FOR DETECTING WASHING COMPLIANCE

TECHNICAL FIELD

The present teachings are directed toward the improved monitoring of washing compliance of body parts.

BACKGROUND

The association of lack of hand hygiene and hospital acquired infections has become a significant focus for regulators in recent years. The United States Centers for Disease Control estimates that one in 10 to 20 admitted individuals to a hospital will acquire an infection or disease from their stay and exposure within a hospital environment. A hospitalized individual is generally more predisposed to infection or disease due to several factors including a weak or depressed immune system, wound exposure, surgery, and the proximity of other individuals that may possess infectious contagions. Although the source of a hospital acquired infection or disease is extremely difficult to track to the original source, the pathogens are most commonly carried in an aerosolized manner or through direct contact with a surface or skin (most commonly a nurse's or doctor's hands). The World Health Organization has determined that hand washing is of primary importance. Hand washing is probably the single most effective mariner to help deter the spread of Hospital-Acquired Infections (HAI).

Current systems used to ensure that individuals wash their hands prior to contact with a patient have several key obstacles to enabling widespread application in the field. Specifically, 1) expense associated with monitoring if water is flowing from a sink; 2) inability to verify that hands are located under the sink and the flowing water; 3) expense associated with determining the identity of the person involved in the non-compliant hand washing event; and 4) expense attributable to Radio Frequency Identification (RFID) transmitting systems.

Prior art systems for detecting water flowing from a sink have known drawbacks. Ultrasonic sensors range in price from $500-$3000 and function efficiently only with dirty, salty or contaminated water. Ultrasonic sensors capable of efficiently detecting clean water flow exceed $3,000 per unit (such as the FD-400 series sold by Omega (www.omega-.comGreen/pdf/FD-400.pdf)). Pressure sensors may also be used to detect water flow from a sink. While these devices are relatively inexpensive, they often provide false values as the drop may be attributable to a sudden pressure drop somewhere else in the building (such as due to a toilet flushing) rather than at the to be monitored sink. Additionally, conductivity sensors located at the water faucet may be used to detect water flow at a sink or hand washing station. However, these units are prone to corrosion, as well as salt and metal deposition which render these sensors unreliable and ineffective for prolonged use.

A survey of systems currently on the market to monitor hand washing compliance indicates that prior art systems fail to provide for one or more of: monitoring soap/sanitizer use, monitoring water use, monitoring exact employee location, visually verifying employee presence, monitoring duration of hand washing, verifying proper hand washing technique, alerting employees, sending information to a web-site, providing additional information at a hand washing station, using a small/unobtrusive badge, work with an existing employee badge, detect alcohol on hands, and indicating compliance with washing at the washing station. In particular, none of the prior art systems monitor whether water is actually flowing due to the expense of existing flow sensor systems.

The use of RFID systems for monitoring individuals as they enter or exit an area is common. For example, International Publication Nos. WO 2007/090470 and WO 2010/026581 A2 illustrate the use of RFID tags in a hospital environment for tracking Use of RFID tags attached to articles to track the articles is known in the art. In addition, an active RFID system that transmits a signal to a receiver station where the unit is equipped with a battery is known in the art.

The use of a position or signal transmitter generally requires the application of an external power supply. These power supplies are generally bulky and add significant weight and cost to a unit that may be portable and require activation or signal transmission upon a primary signal activation. For example, prior art systems describe a badge worn by a doctor that activates a transmitter when the badge comes into proximity with an infrared transmitter. Thus, despite the need, the use of transmitting devices that can easily connect to an RFID network and transmit a signal from a water sensor also becomes prohibitively expensive with current technology.

It is an object of the current invention to provide the ability for the sensor to inexpensively transmit the water flow status to an RFID network.

It is a further object of the current invention to provide a low cost hand wash compliance system capable of detecting whether an individual has washed their hands and that tracks the location of an individual within a room and their proximity to entrance and exit signs, hand washing stations, restricted areas, other individuals, and other physical locations.

It is another object of the current invention to provide a means of associating an individual to the hand washing event and their compliance with effective washing.

It is further an object of the current invention to transmit the information associated with the individual, their location within a restricted area, their hand washing compliance, and the flow of water to an information reporting system.

SUMMARY

According to one embodiment, a liquid flow monitoring system for monitoring washing compliance comprising a sensor disposed near or on a liquid dispenser to generate a vibration signal; a modulator to modulate said vibration signal by amplification; a comparator to determine if the modulated signal exceeds a threshold value, wherein the threshold value identifies liquid flow through an output voltage; and a relay that is actuated using the output voltage is described.

In some embodiments, the sensor comprises one or more of a microphone, a contact pad, a pressure switch, or a combination thereof. In some embodiments, the liquid flow system further comprises a RFID tag and an antenna for the RFID tag in electrical contact with the relay, wherein said antenna is sensitive to an ambient Radio Frequency (RF) signal and the actuated relay electrically connects the antenna to the RFID tag.

In some embodiments, the liquid flow system further comprises an RFID reader capable of being connected to a computer, wherein the RFID reader reads the RFID tag when the relay has been actuated.

In some embodiments, the liquid flow system further comprises a vision system for detecting with an output of a camera one or more of: individuals within an area requiring washing compliance, a location of a body part in the liquid flow, a use of a detergent, a wearing of an ornament while washing, a wearing of a watch while washing, or a wearing of jewelry while washing, wherein the vision system associates the RFID tag with the detecting by the vision system.

In some embodiments, the liquid flow system further comprises an RFID badge and associating the RFID badge with the washing activity occurring.

In some embodiments, the liquid flow system further comprises a second RFID tag in electrical contact with the antenna when the relay is not actuated.

In some embodiments, the liquid flow system further comprises a computer network and an external server for the purpose of reporting and data consolidation.

According to one embodiment, a process for monitoring washing compliance comprising registering a vibration signal generated from a sensor disposed near or on a liquid dispenser modulating said vibration signal by amplification and creating a threshold value to identify liquid flow through an output voltage; and actuating a relay using the output voltage is described. In some embodiments, the process further comprises transmitting an RFID tag with an antenna wherein said antennae is sensitive to an ambient RF signal and the actuated relay electrically connects the antenna and the RFID tag.

In some embodiments, the process further comprises inputting the RFID tag into a computer with an RFID reader.

In some embodiments, the process further comprises detecting with an output of a vision camera one or more of individuals within an area requiring washing compliance, a location of a body part in a liquid flow from the liquid dispenser, a use of a detergent, a wearing of an ornament while washing, a wearing of a watch while washing, or a wearing of jewelry while washing, or a combination thereof; and associating the RFID tag with the detecting. In some embodiments, the process further comprises providing a user with an RFID badge and associating the RFID badge with the washing activity occurring within an area requiring hand washing compliance. In some embodiments, the process further comprises reporting and data consolidating the washing compliance. In some embodiments, the process further comprises wherein the vision detection system is capable of detecting a hand, a ring, a watch, jewelry, a user, or a combination thereof.

According to one embodiment, a switched antenna device comprising a connector to receive a signal from a sensor; a modulator to modulate said signal; a comparator to determine if the modulated signal exceeds a threshold value through an output voltage; a relay that is actuated using the output voltage; an RFID tag; and an antenna for the RFID tag in electrical contact with the relay, wherein said antenna is sensitive to an ambient RF signal and the actuated relay electrically connects the antenna to the RFID tag.

In some embodiments the switched antenna device includes wherein the sensor comprises one or more of a microphone, a contact pad, or pressure switch, or a combination thereof. In some embodiments the switched antenna device includes an RFID reader capable of being connected to a computer, wherein the RFID reader reads the RFID tag when the relay has been actuated. In some embodiments the switched antenna device includes wherein the device receives signals from a contact pad for an individual to step upon, a contact switch disposed on a soap dispenser, and a vibration sensor disposed on a sink. In some embodiments the switched antenna device further comprises an RFID reader capable of being connected to a computer.

In summary, the following invention provides a low cost solution for detecting the flow of water in a sink using a non-contact vibration sensor coupled with a computer vision system and a passive RFID tag that may become active upon detection of water flow. The water flow sensor may be formed using a piezo electric film that may be attached to the underside of a sink to collect the sound generated by water splashing or hitting the sink. A voltage level created can actuate a switching relay. Additional data collected may include whether a person has entered a predefined area, or is in proximity to a sink or exit doors. The data can be collected using a combination of RFID signal processing (e.g., activated by a badge worn by the personnel) in addition to computer vision camera processing. The visual imaging may allow for the detection of the hand washing procedure in the sink, as well as the use of soap or other detergent, as well as the physical tracking of individuals. This visual information may be simplified to provide a "yes" or "no" indication signaling whether the hand cleaning event occurred. A report may be generated and optionally provided via network, e-mailed or a web-based interactive system. In addition, warnings can be sent via pager or telephone (such as texting) to provide warnings and reports in real time.

The invention will herein be further described in connection with the following drawings, photographs, and tables.

FIGURES

The same reference number represents the same element on all drawings. It should be noted that the drawings are not necessarily to scale. The foregoing and other objects, aspects, and advantages are better understood from the following detailed description of a preferred embodiment of the invention with reference to the drawings, in which:

FIGS. 12*a* and 12*b* illustrate a report generated using the liquid flow system of FIG. 10.

DETAILED DESCRIPTION

Figure 1:
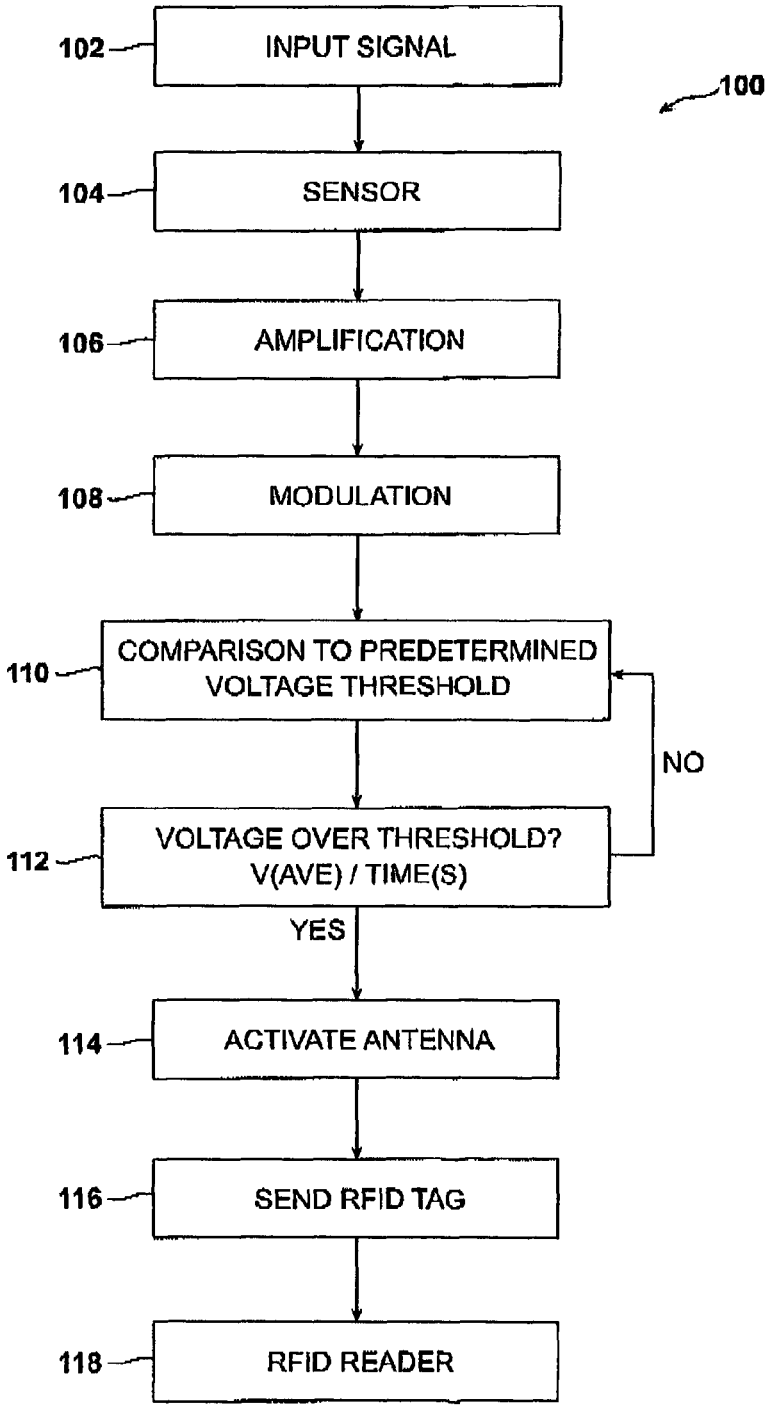
FIG. 1 illustrates a system and a process for monitoring washing compliance according to one embodiment.

FIGS. 1-12 and the following descriptions depict specific embodiments to teach those skilled in the art how to make and use the best mode of the teachings. For the purpose of teaching these principles, some conventional aspects have been simplified or omitted. Those skilled in the art will appreciate variations from these embodiments that fall within the scope of the teachings. Those skilled in the art will also appreciate that the features described below can be combined in various ways to form multiple variations. As a result, the teachings are not limited to the specific embodiments described below, but only by the claims and their equivalents.

As mentioned above, the present disclosure relates to a low cost hand wash compliance system capable of detecting whether an individual has effectively washed their hands in order to prevent, among other things, the spread of HAI. The system can detect and track the location of an individual within a room and their proximity to entrance and exit signs, hand washing stations, restricted areas, other individuals, and other physical locations.

As used herein, "effective washing" or "hand washing compliance" refers to a pre-determined series of systematic steps or requirements that must: 1) be performed by an individual when washing or sanitizing their hands; 2) be sufficiently detected by a sensing system; and 3) be sufficiently processed and/or compiled into representative data reporting the detecting of the individual washing or sanitizing of their hands. In a non-limiting example, "effective washing" or "hand washing compliance" can include steps such as turning on a faucet, detecting water flowing from a faucet, detecting the presence of a user standing on a mat in front of a sink, and reporting data showing the detection of the turning on of the faucet, the detection of water flowing from a faucet, and the presence of a user on the mat. In another non-limiting example, "effective washing" or "hand washing compliance" can include steps such as a user pumping a hand pump dispensing hand sanitizer, detecting sanitizer flowing from the hand pump, detecting the presence of a user standing in near proximity to the sign for the hand sanitizer, and reporting data showing the detection of the pumping of the hand pump, the detection of sanitizer flowing from the pump, and the presence of a user near the sign for the hand sanitizer. Failure to sufficiently detect or report any steps (even if the steps were performed by a user) would not result in effective washing or hand washing compliance.

As used herein, a "non-contact biometric identification system" or "vision detection system" refers to method that correctly identifies a person required to perform hand washing without contact based upon a particular characteristic of that individual by 1) sufficiently imaging or recording the individual at a hand washing station; 2) sufficiently comparing that image or recording to a database of images or audio recordings; 3) sufficiently identifying the individual person based upon comparisons the database(s); and 4) sufficiently processing and/or compiling representative data reporting the detecting of the identity of the individual washing or sanitizing of their hands. The characteristic may include physiological or behavioral characteristics of a person, including but not limited to, shape, body, fingerprint, palm print, facial recognition, DNA, geometry (body, hand etc.), iris, retina, odor, posture, gait, and/or voice. The "non-contact biometric identification system" or "vision detection system" must: 1) utilize visual or audio based technology to "see" (e.g. image) or "hear" (e.g. audio record) a person in order to establish the identity of the person. This can be done by previous exposure to a person, or due to the first experience with a person. For example, all employees of a hospital utilizing the hand washing compliance system described herein are photographed in specific poses, or have specific portions of their body imaged (e.g. face, hands, head, etc.). The images may then be stored on a data network for later comparison. In one embodiment, voice recordings of all employees are made saying a particular word or phrase (e.g. their name, "yes" or "no", etc.). The non-contact biometric identification system can then utilize those stored images and audio files to identify a worker in the hospital. The "non-contact biometric identification system" or "vision detection system" may utilize a vision camera, webcam or similar device for capturing video or images.

FIG. 1 illustrates a system and a process for monitoring washing compliance 100 according to one embodiment. Input signal 102 is received by sensor 104. The sensor converts the signal into an electrical signal, usually voltage. Sensor 104 can include a vibration sensor, a contact switch, a pressure switch, a bellow sensor, a temperature sensor, a light sensor and/or combinations thereof. The electrical signal is subjected to amplification 106 and subsequently modulation 108. The modulated voltage is compared to a predetermined voltage threshold 110. In some embodiments, when the modulated voltage exceeds the threshold voltage for a desired duration, it can trigger or complete a secondary circuit. In some embodiments, the desired duration can be zero seconds; in other works, even a momentary excess of modulated voltage can trigger the relay. When the samples sampled exceeds the predetermined voltage threshold 110 with enough frequency (shown at step 112), activation of secondary circuit/RFID antenna 114 may occur. In some embodiments, the secondary circuit comprises a relay. In some embodiments, the secondary circuit can comprise activating an RFID antenna. The activation of RFID 114 antenna can permit an RFID tag to energize, which enables a sending of an ID/token stored in the RFID tag to an RFID reader 118. The RFID reader 118 can be electrically coupled to additional computers, networks, cellular devices, etc., as known in the art.

Figure 2:
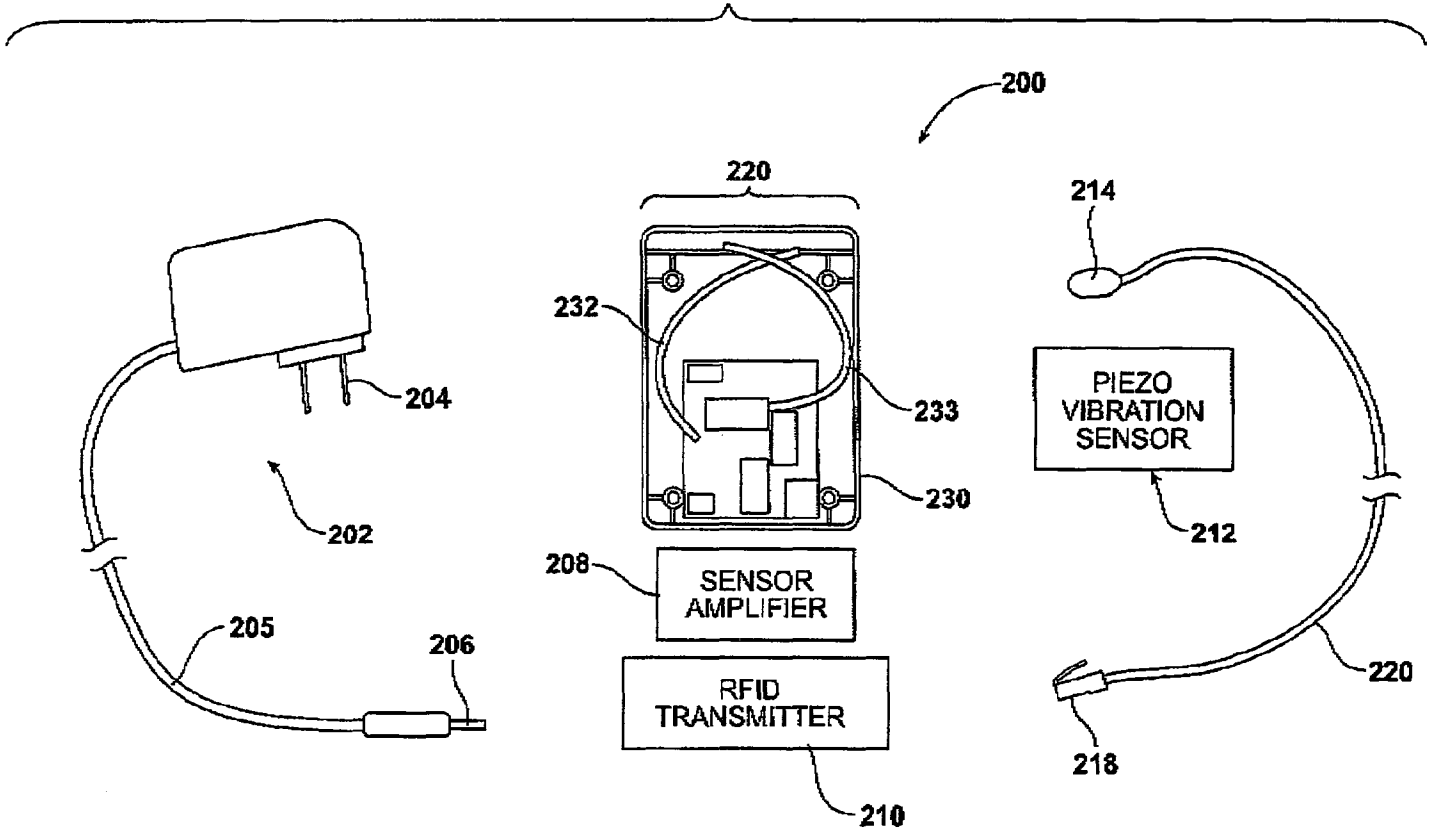
FIG. 2 illustrates a liquid flow system according to one embodiment.

FIG. 2 illustrates an embodiment of a liquid flow system 200 suitable for use for detecting washing compliance. The liquid flow system 200 may include piezo vibration transducer 212, and a switch antenna device 220 which can include sensor amplifier 208 and RFID transmitter 210. Piezo vibration transducer 212 may include a receiver portion 214 that is connected to a data modular connector plug 218 via wire 220. Sensor amplifier 208 and RFID transmitter 210 may be housed in housing 230 of switched antenna device 220. Antenna 232 and 233 may transmit an RFID signal. Power to antenna 232 and 233 may be restricted to a predetermined voltage threshold. Failure to reach the predetermined voltage threshold may prevent any RFID signals from being transmitted.

The sensor amplifier 208 and RFID transmitter 210 may have the same or separate power supplies. Power may be supplied to sensor amplifier 208 or RFID transmitter 210 via a power supply 202. Power supply 202 may have a standard 110V plug 204, a main wire portion 205, and a jack portion 206. Jack portion 206 may be inserted into a jack receiver (not shown) located within housing 230 in order to provide power to the sensor amplifier 208 or RFID transmitter 210. In some embodiments, sensor amplifier 208 or RFID transmitter 210 may be powered by stored energy, such as a battery.

Figure 3:
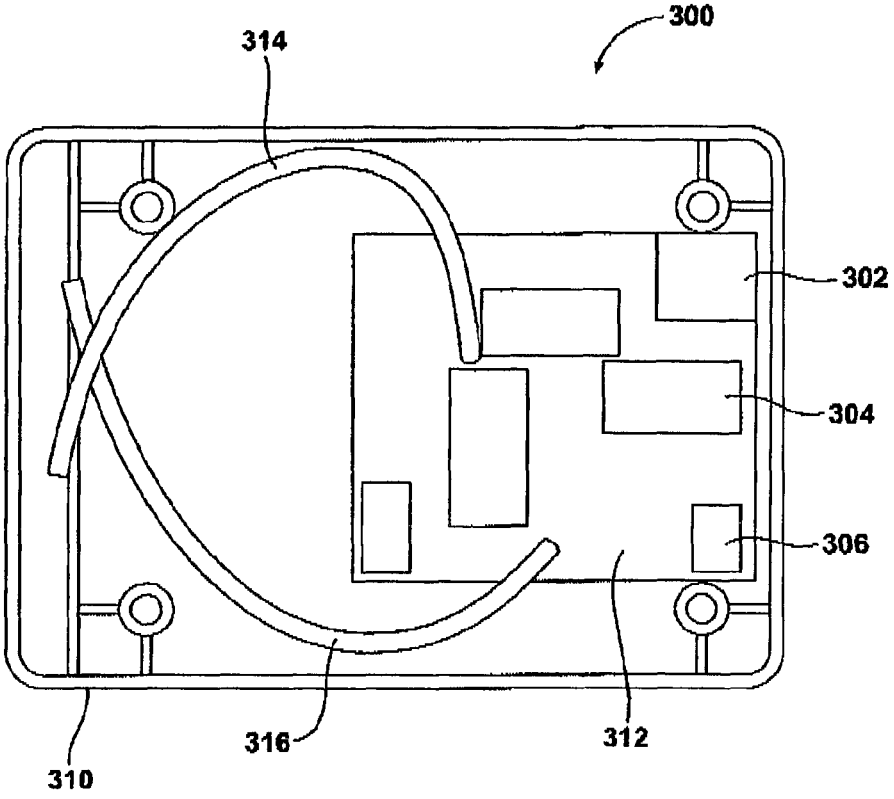
FIG. 3 illustrates a switched antenna device according to one embodiment.

FIG. 3 shows the switched antenna device of FIG. 2 that may be used to sense when liquid, such as water, flows into a sink sufficiently to activate an antenna to relay the signal to an sensor reader. Switched antenna device 300 can include a sensor connector 302 that receives the electrical signal from a sensor receiver portion (not shown). Switched antenna device 300 can also include a power connector port 304 that allows switched antenna device 300 to receive energy from a power source, such as a standard wall outlet. Switched antenna device 300 may include circuit board 312 which electrically connects all of the various components of switched antenna device 300. Switched antenna device 300 may include housing 310 which encloses all of the various components of switched antenna device 300. Switched antenna device 300 can comprise a voltage sensitivity adjustor 306 which can modulate the voltage signals received to remain below a predetermined voltage threshold. Switched antenna device 300 can comprise one or more RFID chips capable of producing RFID signals. Additionally, switched antenna device 300 can comprise one or more RFID antenna (314 and 316) selectively electrically coupled to circuit board 412.

Figure 4:
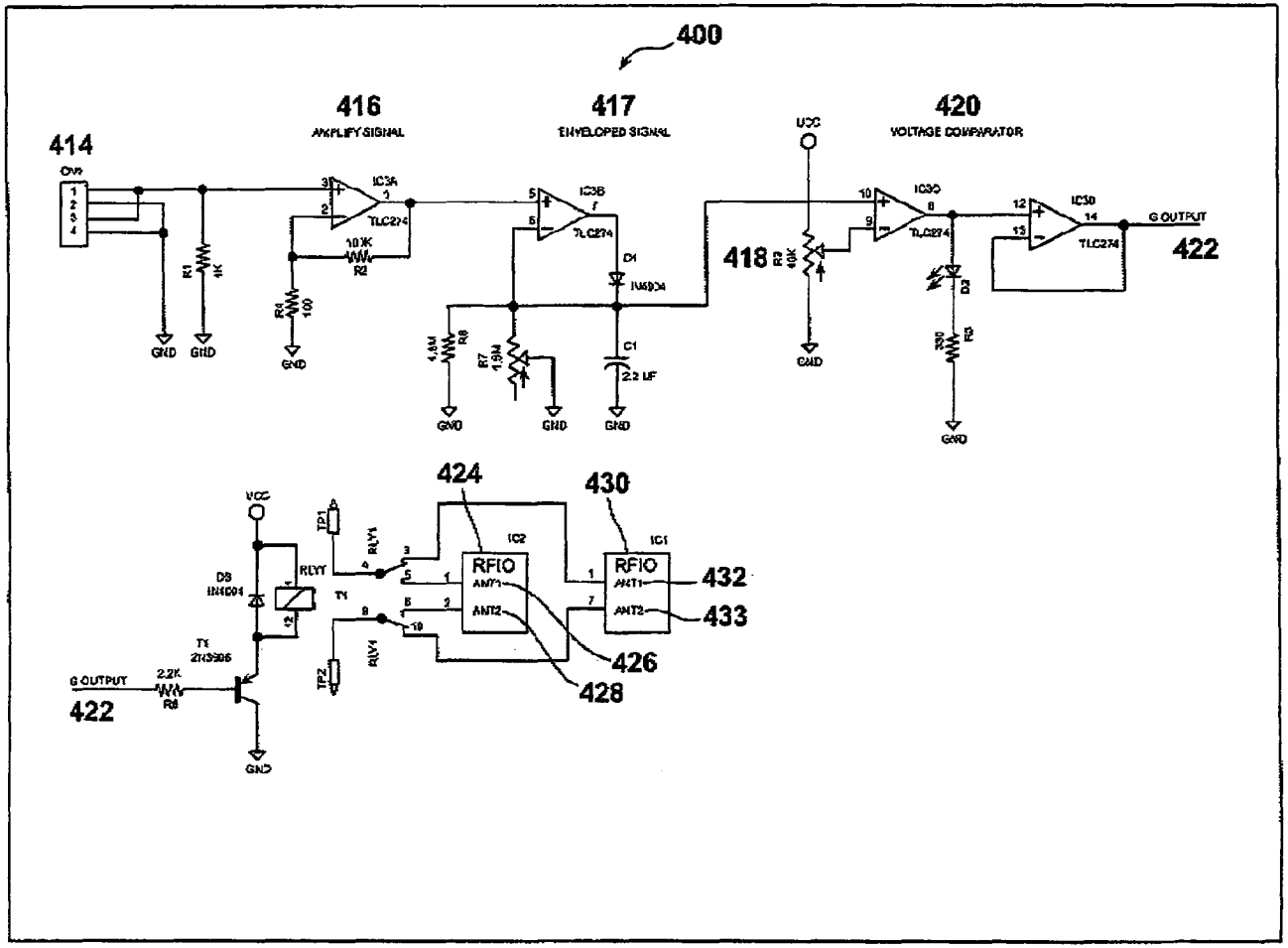
FIG. 4 illustrates a liquid flow system according to one embodiment.

FIG. 4 illustrates an electrical diagram for a switched antenna device or water flow sensor 400. An electrical signal is received from a sensor (not shown) suitable for use in a system and process for monitoring washing compliance. The signal is received at connector 414 as a voltage signal. The voltage is amplified by amplifier 416 and modulated by using an enveloping circuit 417. A variable resistor 418 can adjust the value of a predetermined voltage threshold. Adjustment of the predetermined voltage threshold may allow for overcoming background noise signals. A voltage comparator 420 compares the modulated signal to the predetermined voltage threshold. When the modulated signal sufficiently exceeds the predetermined voltage threshold level (after amplification and envelopment/modulation), an output voltage 422 is held. The output voltage 422 may be sufficient to activate a relay RLY1 connecting one or more of RFID antenna signals 426, 428, 432, 433 from one or more RFID tags 424 and 430. Multiple RFID tags may be utilized for redundancy. In this embodiment, respective RFID antenna signals of RFID tag 430 and RFID tag 424 are alternatively connected to an RFID antenna TP1. RFID tag 430 can, for example, indicate that switched antenna device or water flow sensor 400 is in a specific location even when voltage output 422 is insufficient to activate relay RLY1. Activation of relay RLY1 can allow RFID tag 424 to be read. This reading can, for example, indicate that switched antenna device or water flow sensor 400 has sensed the to be detected event.

Figure 5:
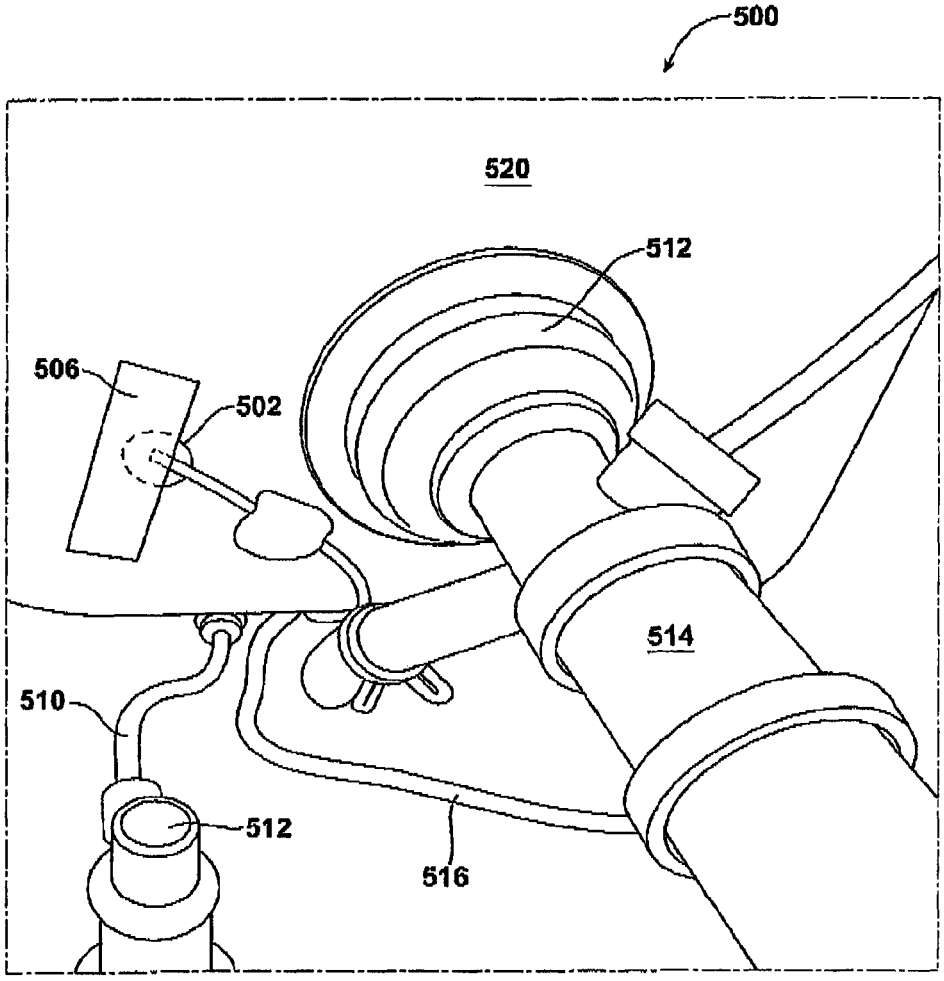
FIG. 5 illustrates the circuitry for a system and process of a liquid flow system according to one embodiment.

FIG. 5 illustrates an embodiment of a liquid flow system 500 that may be mounted to the underside of a liquid receptacle. In this example, piezo vibration transducer 502 is fastened to the underside of liquid receptacle (e.g. sink) 520 via fastener 506. Fastener 506 may include adhesives (enamels, epoxies, glues, etc.), tape, screws, or other such means. In a non-limiting example, water (not shown) released from water source 512 travels through water supply hose 510 and into, and through a faucet (not shown). When the water makes contact with liquid receptacle 520, it travels through drain 512 and into waste pipe 514. The vibration of the water leaving the faucet or striking a surface of liquid receptacle 520 may then be detected by piezo vibration transducer 502. The signal travels through wire 516 to a switched antenna device (see, for example, FIGS. 3 and 4) where the signal is received and processed.

Figure 6:
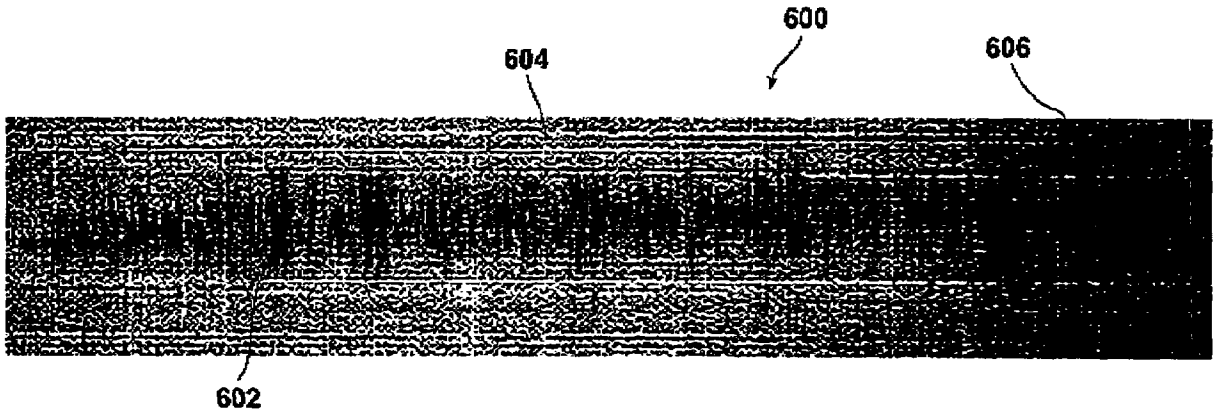
FIG. 6 illustrates an amplified signal tracing of the output voltage of a liquid flow system according to one embodiment.

FIG. 6 represents an amplified signal tracing 600 from a piezo vibration transducer (e.g., FIG. 2) that has been masked (and/or enveloped) in comparison to a predetermined threshold voltage 604. When the voltage of the amplified signal 602 exceeds predetermined threshold voltage, for example at time stamp 606, the voltage may be sufficient to provide energy to an RFID antenna to transmit an RFID tag to an RFID receiver indicating water flow. A system can then be activated to determine if a person is currently washing their hands.

Figure 7:
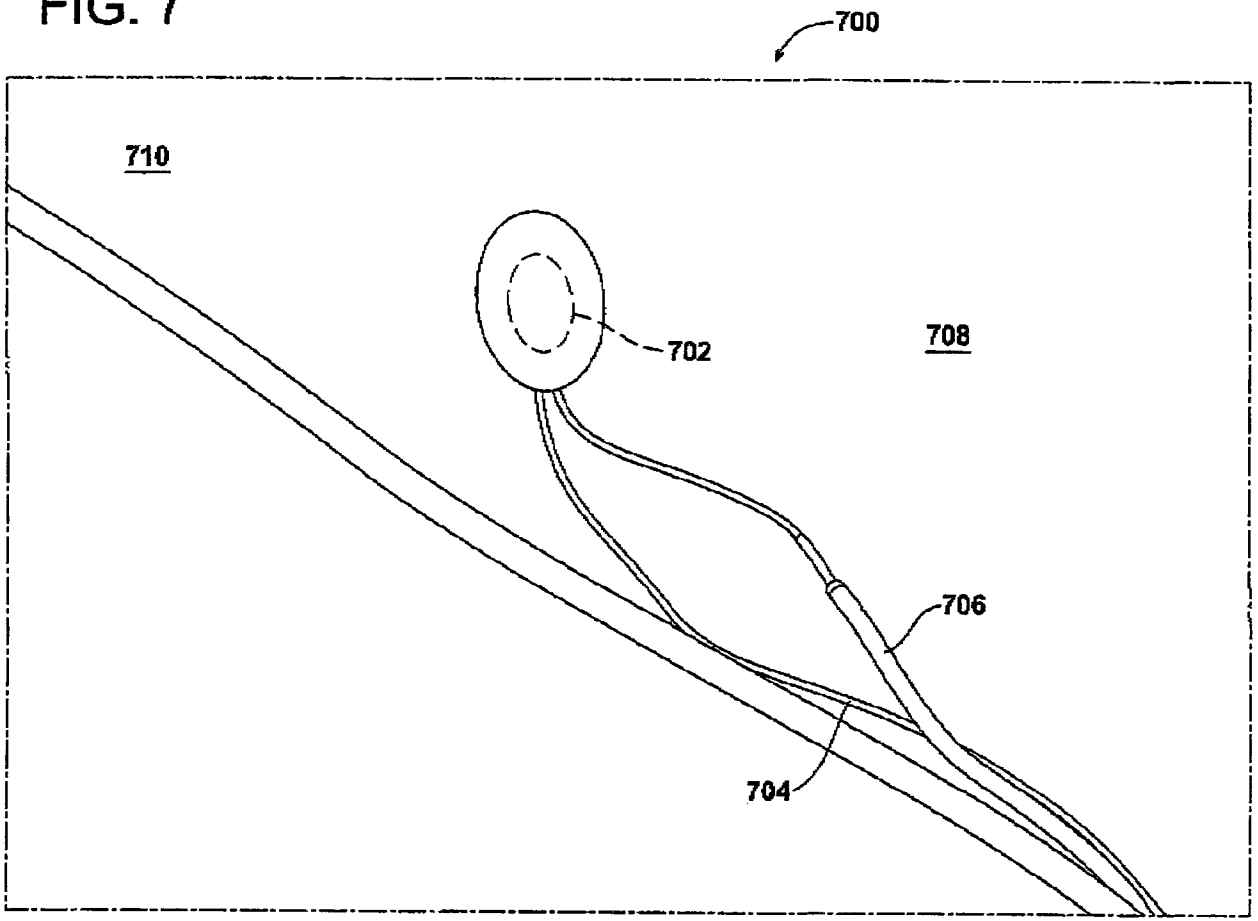
FIG. 7 illustrates a liquid flow system according to one embodiment.

FIG. 7 illustrates an embodiment of a liquid flow system 700 that may be mounted to a liquid soap dispenser or hand sanitizer pump that is located on a wall 710. In this example, piezo vibration transducer 702 is fastened to the side of liquid soap dispenser housing 708 via an adhesive (not shown). In a non-limiting example, when a user pumps the liquid soap dispenser handle (not shown), the vibration of the liquid soap dispenser housing 708 may then detected by piezo vibration transducer 702. The signal travels through wires 704 and 706 to a switched antenna device (see, FIGS. 2 and 3) there the signal may be received and processed according to FIG. 4.

Figure 8:
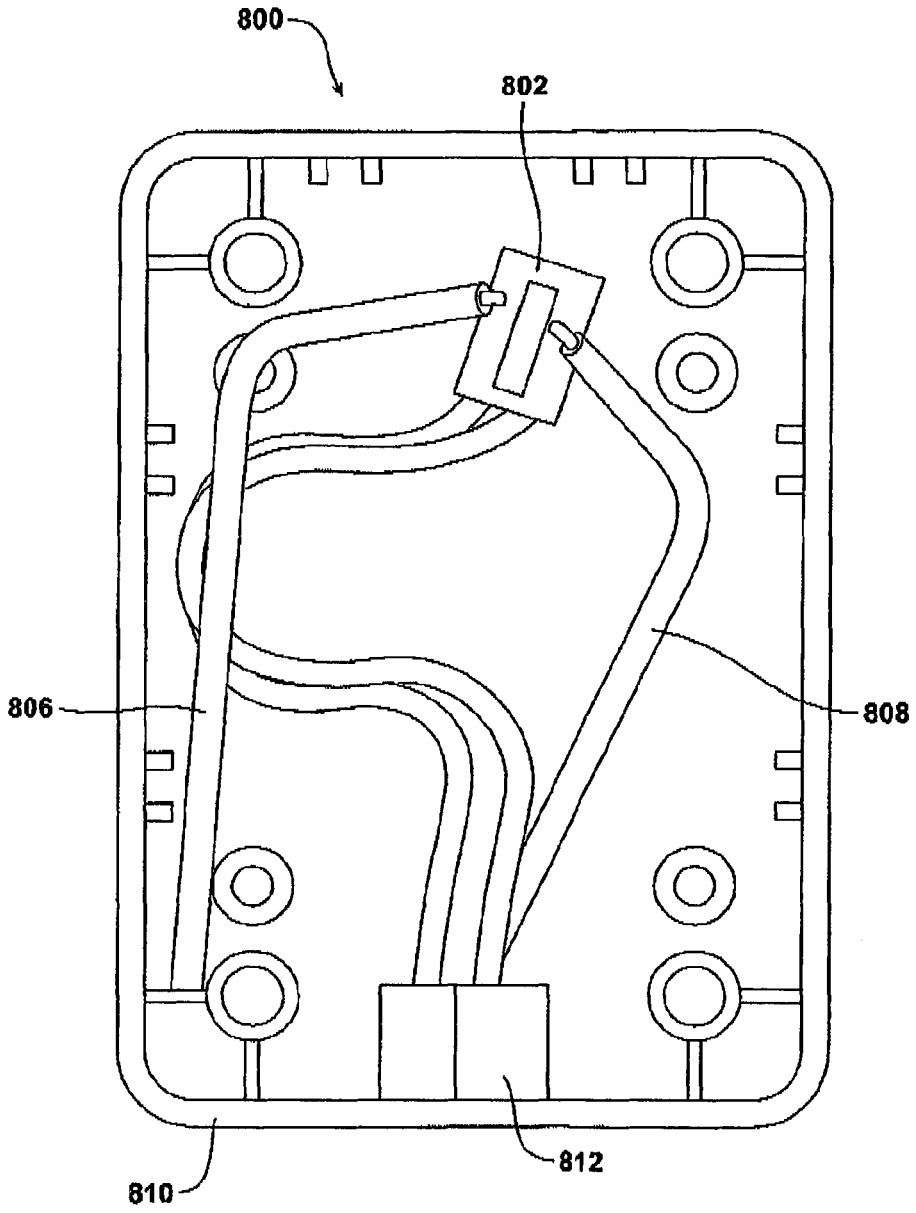
FIG. 8 illustrates a switched antenna device according to one embodiment.

FIG. 8 shows another example of a switched antenna device 800 suitable for use in a liquid flow sensor. Switched antenna device 800 can include a sensor connector 812 that receives the electrical signal from a receiver portion of a sensor. Switched antenna device 800 may include housing 810 which encloses all of the various components of switched antenna device 800. Switched antenna device 800 can comprise RFID chips 802 capable of producing RFID signals. Additionally, switched antenna device 800 can comprise one or more RFID antennas (806 and 808) that are selectively electrically coupled to RFID chip 802. In this embodiment, antenna 806 and 808 may be activated when impinged by an external RFID reader. The output of the RFID chips 802 can thus provides information on liquid flow even if a sensor connected to sensor connected 8112, switched antenna device 800 and/or a liquid receptacle are located in locations that does not permit for one or more of them to be connected a computer.

Figure 9:
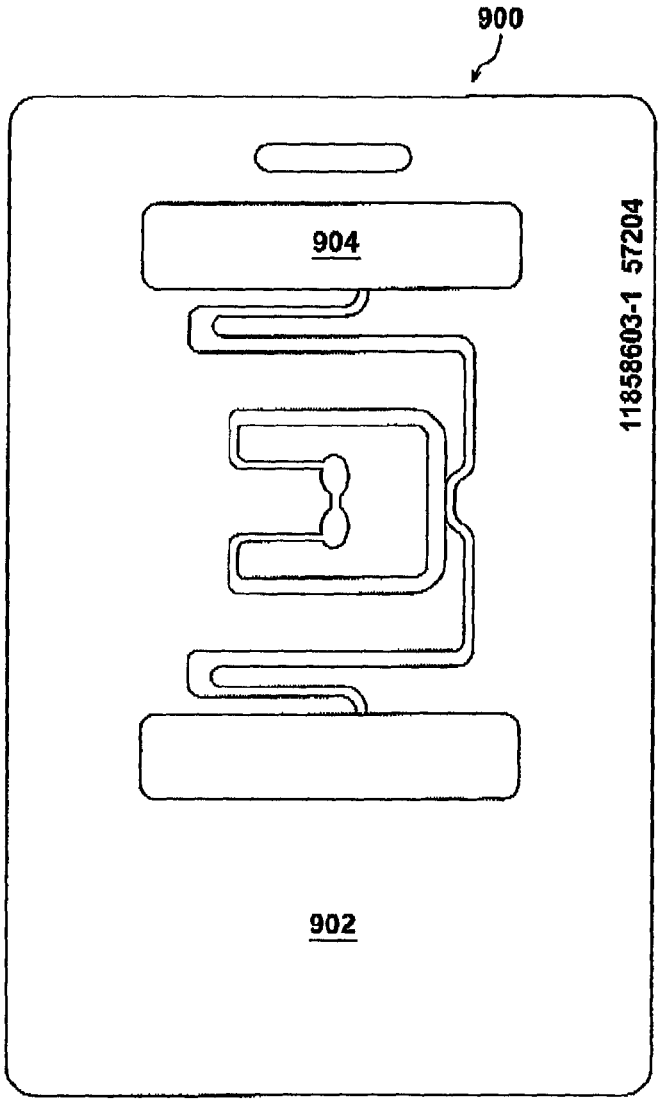
FIG. 9 illustrates an RFID tag on an identification badge in a liquid flow system according to one embodiment.

Identification of a particular individual may be obtained by reading a badge 900 such as that shown in FIG. 9 through the RFID antennas and sensors placed in an area. For example, an RFID sensor may be placed in a room in close proximity to a hand washing station. Thus an individual wearing badge 902, which includes an RFID tag 904, will be detected by an RFID reader (not shown) only when the individual is close enough to the RFID sensor. Each RFID tag 904 can be assigned to a unique individual, and each RFID reader may be assigned to a specific location, such as a hand washing station. Thus, the system is able to detect what, when and for how long are individuals in close proximity to a hand washing station.

Figure 10:
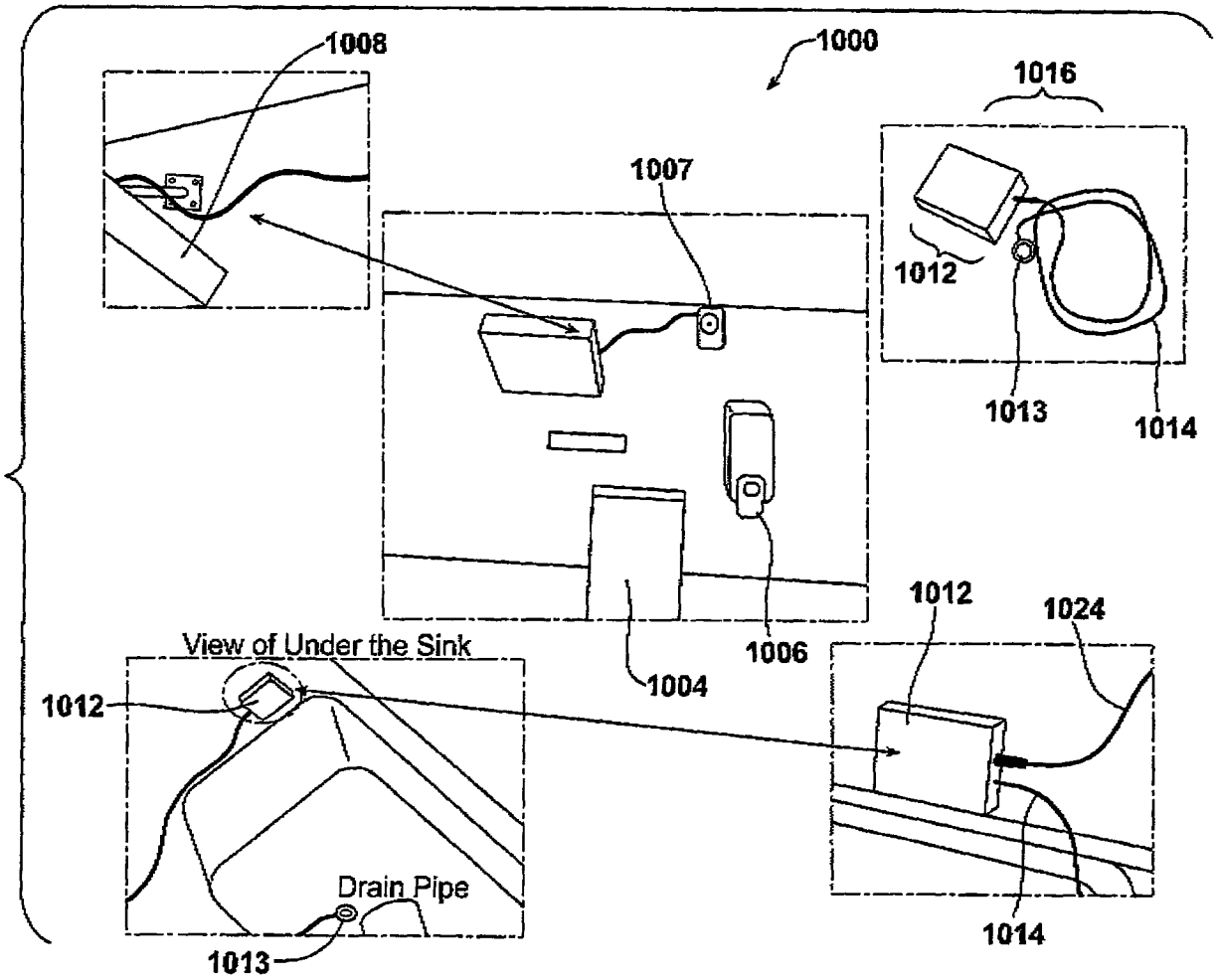
FIG. 10 illustrates a system and process for monitoring washing compliance according to one embodiment.

An example of a liquid flow system for monitoring washing compliance 1000 is shown in FIG. 10. The liquid flow system for monitoring washing compliance 1000 may include placements of cameras 1007, RFID sensors 1008, and liquid flow systems 1016 including receiver portion 1013 coupled to switched antenna device 1012 via cable 1014 at a sink 1020. Receiver portion 1013 coupled to switched antenna device 1012 may be provided with a power supply via power cord 1024. Additional receiver portions of liquid flow systems may be located on faucet 1004, or liquid dispensing pump 1006. RFID sensors 1008 may detect the proximity of RFID tags mounted on ID badges worn by a user (e.g. FIG. 9).

Figure 11:
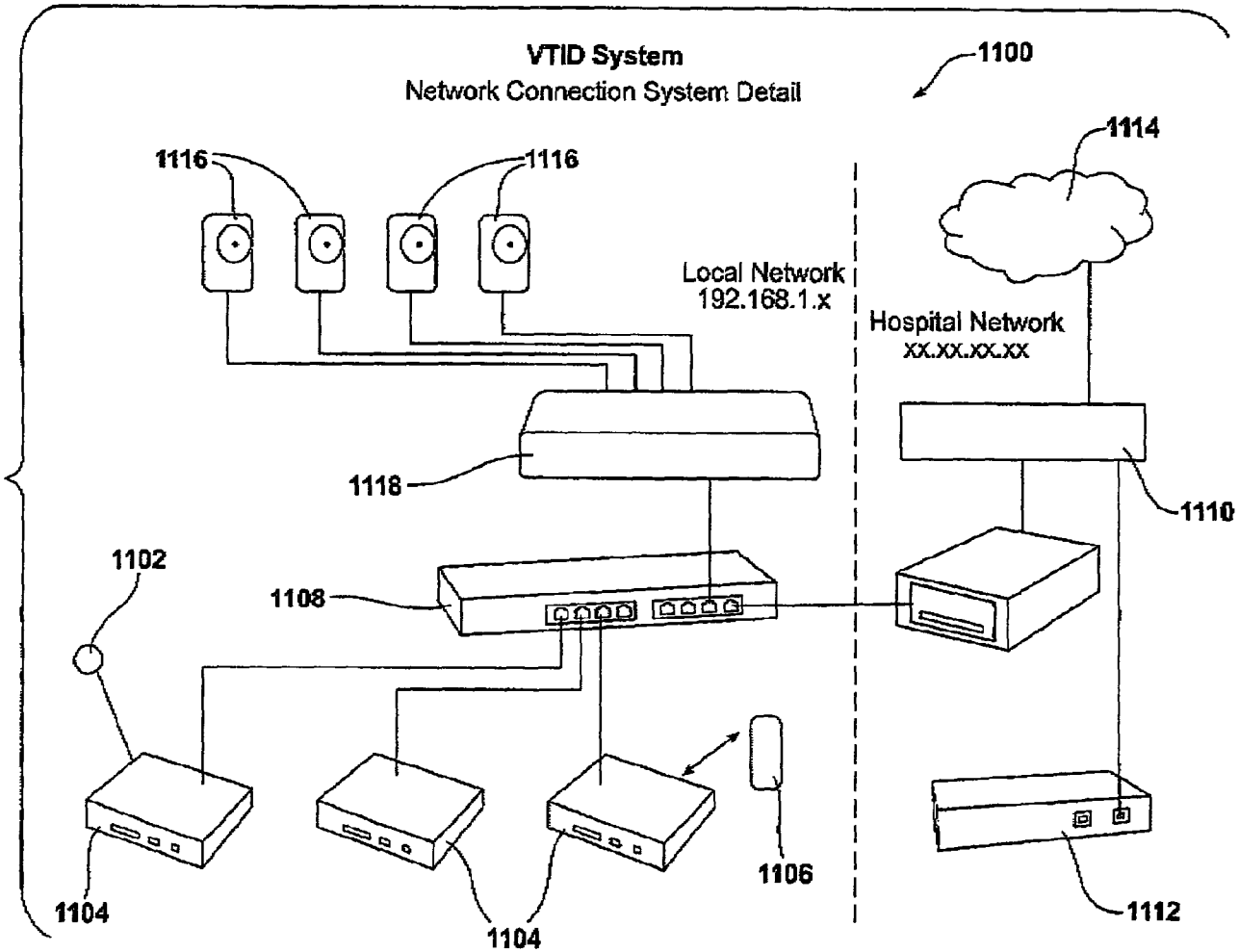
FIG. 11 illustrates a system and process for monitoring washing compliance according to one embodiment.

FIG. 11 illustrates an example of a network 1100 that may be used to communicate the information data received from the various components of a liquid flow system for monitoring washing compliance. For example, liquid flow system 1102 may directly communicate with RFID readers 1104. In another example, information from a liquid flow system 1102 may be communicated with a switched antenna device

1106 to an RFID reader 1104. The RFID readers 1104 may be integrated into a Power over Ethernet Switch 1108 which is then connected to a hospital network 1110. Additionally, cameras 1116 may be coupled to a network, which is, in turn, coupled to a Power over Ethernet Network Switch 1108, and may thus also be connected to a hospital network 1110. Additional network components include remote power switches 1112. Data collected over a hospital network 1110 may further be transmitted or shared via the internet 1114.

Cameras 1116 may provide additional visual data confirming the presence of hands in a sink (or other liquid receptacle), or the use of a soap detection sensor to report and identify individuals who are cleaning their hands just minimally. Cameras 1116 may be linked to hospital network 1110 via network switch 1118.

Figure 12B:
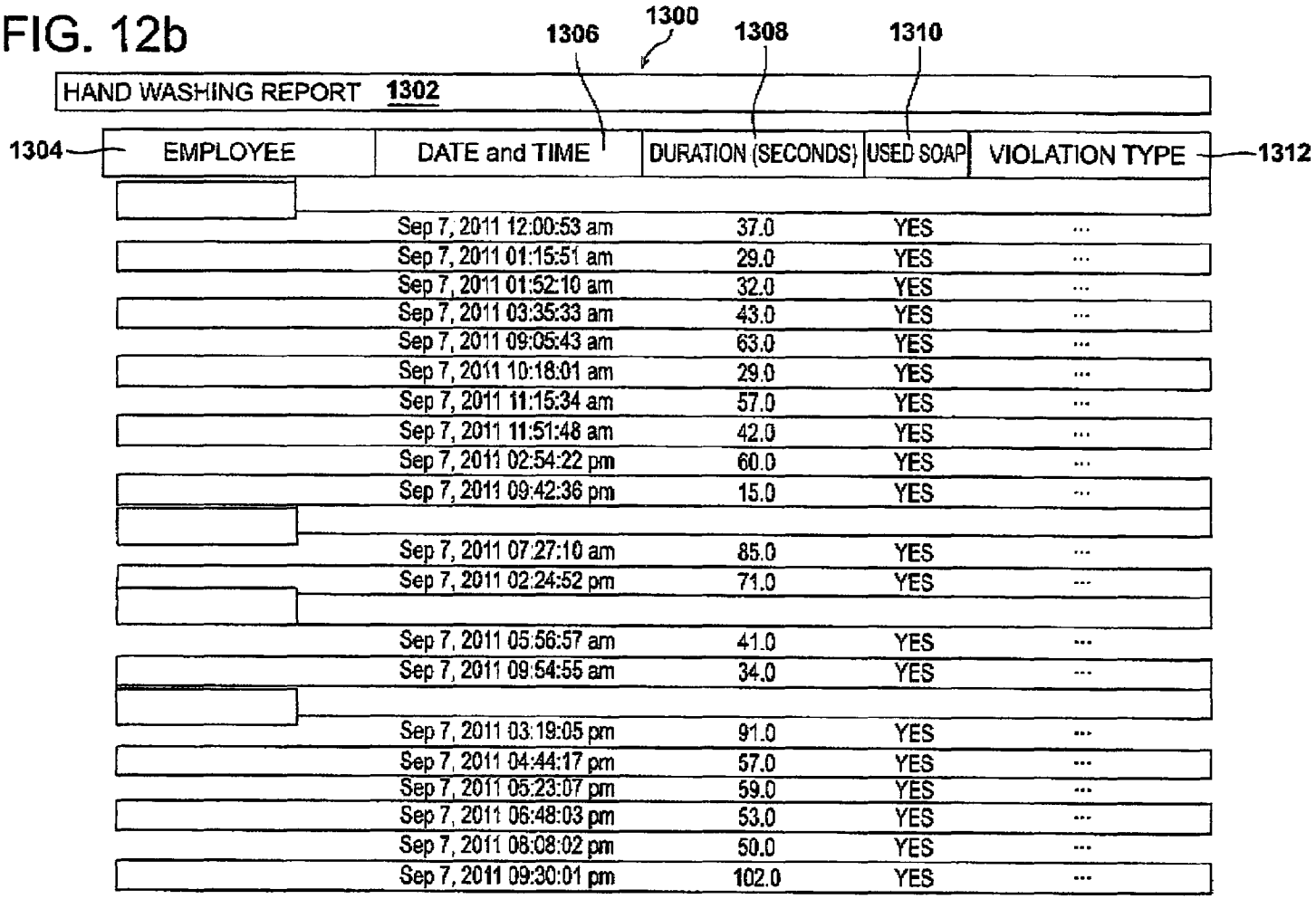

Information gathered from a system as described in FIGS. 10 and 11 may be used to create a report such as that shown in as further shown in FIGS. 12*a* and 12*b*. FIG. 12*a* is an exemplary report 1200 to summarize hand washing 1202. The summary can be by employee 1204. The duration of hand-washing 1206 can include data columns such as minimum washing time in seconds 1208, average washing time in seconds 1210 and maximum washing in seconds 1212. The elapsed time between hand-washing 1214 can include data columns such as average time between washing in seconds 1216 and maximum time between washings in seconds 1218. A number of handwashing events 1220 and types of violations 1222 can also be provided.

FIG. 12*b*. is an exemplary report 1300 to summarize hand washing 1302. The summary can be by employee 1304. Washing compliance can be collected for various clinicians including the time of washing 1306, a duration 1308, whether they used soap 1310 and what type of washing compliance violation 1312 was detected.

EXAMPLE

As one example of a "hand wash detection module" which monitors employees entering a clean-room preparation room, called an anti-room, where they must wash their hands and/or other body parts prior to entering the clean room. The system may include 1) a non-contact water flow sensor such as that described above coupled with an RFID tag switch such as that shown in FIGS. 2 and 8) an RFID system on personal badges for individual identification; and 3) a vision system utilizing cameras to detect hand washing and soap use. The system hardware may include a computer. An exemplary computer system can comprise: Mfg: Antek, Intel, Corsair, Seagate Model: ISK 300-150 (enclosure), BOXD510MO (motherboard), VS2GB667D2 (memory), ST9320423AS (hard drive), IP cameras (Mfg: Trendnet Model: TV-IP110W), RFID sensors (Mfg: Thing Magic Model: Astra A5-NA-POE), network switches (Mfg: Netgear Model: GS108P) and a remote power switch. The IP cameras may be positioned in the anti-room to capture images of the sink and the two doors leading into/out of the anti-room. The cameras may be set-up to capture still images when they detect motion, and are connected to a local network with the host computer. These color images may be in JPEG format with a resolution of 640×480 pixels and may be time and geo-location stamped. These images may be immediately sent via the FTP protocol through the local network to the local host computer. An FTP server may be running on the host computer. On the host computer, there may be individual folders setup for each camera ("CAM01" and "CAM02," etc.), and within these folders, there may be sub-folders named with the current date of the images (i.e., "20100815"). The captured images are located in these sub-folders. The time of day may be used for the image's filename, so each captured image has a unique name. The images may remain on the computer's hard drive until manually purged.

RFID readers may be positioned in the anti-room to capture the unique ID number of the RFID tags affixed to each employee's ID badge when they are in the anti-room. The RFID readers may be connected to the same local network as the IP cameras and the host computer. The host computer may command the RFID readers to broadcast their signal (one sensor at a time) and the RFID tags may respond by transmitting their unique ID number. Software running on the host computer may creates a log file that stores the received responses from each RFID reader, along with a time stamp. The host computer in this example is a standard PC computer running Windows XP operating system. The host computer is connected to both a local network (connecting the IP cameras and the RFID readers) and the hospital's network (via a fixed IP address provided by the hospital's IT department). Internet access is provided by the hospital's network which provides the ability to (a) transmit hand wash data to our website and (b) gives us remote access to our host computer (using "Log Me In" software). A remote power switch (RPS) (Mfg: Deltronix Enterprises Model: RPS-ERP-IP 9258T) is also used to provide the ability to restart the host computer if becomes unresponsive to network pings generated by the RPS. The RPS is configured to ping the host computer every minute and will cycle power to the computer if no ping response is received. In addition, an email notification to our technical staff is generated by the RPS when the RPS cycles power to the host computer. The detection process is performed by a dedicated program continuously running on the host computer. Every few minutes, the IP camera images in the folders and the RFID log files are scanned for new activity. The images are processed through proprietary detection algorithms that detect hand wash events and the duration. The log file entries are also processed, also determining hand wash events and their duration. Information from the two are combined and a single hand wash event notification is sent to the VTID website via a "data push," consisting of a URL call with specific parameters. This "data push" is received and an entry in the VTID database is created. Various user selectable reports can be generated from the VTID website based on the information contained in the "data pushes."

The liquid flow system for monitoring washing compliance can be implemented according to any of the embodiments in order to obtain several advantages, if desired. The invention can provide an effective and cost-efficient detection and monitoring system with reduced costs, increased ease of use and unobtrusive redundancy in order to provide accurate results. The various embodiments described above are provided by way of illustration only and should not be construed to limit the invention. Those skilled in the art will readily recognize the various modifications and changes which may be made to the present invention without strictly following the exemplary embodiments illustrated and described herein, and without departing from the true spirit and scope of the present invention, which are set forth in the following claims.

What is claimed:

1. A liquid flow system for monitoring washing compliance comprising:

a sensor disposed near or on a liquid dispenser to generate a vibration signal;

a modulator to modulate said vibration signal by amplification;

a comparator to determine if the modulated signal exceeds a threshold value, wherein the threshold value identifies liquid flow through an output voltage;

a relay that is actuated using the output voltage; and a Radio Frequency Identification (RFID) tag and an antenna for the RFID tag in electrical contact with the relay, wherein said antenna is sensitive to an ambient Radio Frequency signal and the actuated relay electrically connects the antenna to the RFID tag.

2. The system of claim 1, wherein the sensor comprises one or more of a microphone, a contact pad, a pressure switch, or a combination thereof.

3. The system of claim 1, further comprising an RFID reader being connected to a computer, wherein the RFID reader reads the RFID tag when the relay has been actuated.

4. The system of claim 1, further comprising a vision system for detecting with an output of a camera one or more of: individuals within an area requiring washing compliance, a location of a body part in the liquid flow, a use of a detergent, a wearing of an ornament while washing, a wearing of a watch while washing, or a wearing of jewelry while washing, wherein the vision system associates the RFID tag with the detecting by the vision system.

5. The system of claim 4, further comprising an RFID badge and associating the RFID badge with the washing activity occurring.

6. The system of claim 1, further comprising a second RFID tag in electrical contact with the antenna when the relay is not actuated.

7. The system of claim 1, further comprising a computer network and an external server for the purpose of reporting and data consolidation.

8. The system of claim 4, wherein the vision detection system is detecting a hand, a ring, a watch, jewelry, a user, or a combination thereof.

9. A process for monitoring washing compliance comprising:

registering a vibration signal generated from a sensor disposed near or on a liquid dispenser;

modulating said vibration signal by amplification and creating a threshold value to identify liquid flow through an output voltage;

comparing to determine if the modulated signal exceeds a threshold value, wherein the threshold value identifies liquid flow through an output voltage;

actuating a relay using the output voltage; and transmitting an RFID tag with an antenna wherein said antennae is sensitive to an ambient Radio Frequency signal and the actuated relay electrically connects the antenna and the RFID tag.

10. The process of claim 9, further comprising inputting the RFID tag into a computer with an RFID reader.

11. The process of claim 9, further comprising:

detecting with an output of a vision camera one or more of individuals within an area requiring washing compliance, a location of a body part in a liquid flow from the liquid dispenser, a use of a detergent, a wearing of an ornament while washing, a wearing of a watch while washing, or a wearing of jewelry while washing, or a combination thereof; and associating the RFID tag with the detecting.

12. The process of claim 9, further comprising:

providing a user with an RFID badge; and associating the RFID badge with the washing activity occurring within an area requiring hand washing compliance.

13. The process of claim 9, further comprising reporting and data consolidating the washing compliance.

* * * * *